United States Patent [19]

Prade et al.

[11] Patent Number: 4,466,373

[45] Date of Patent: Aug. 21, 1984

[54] FOOTLOOPS ON SURFBOARDS

[75] Inventors: Ernstfried Prade, Weilheim; Hans Fichtner, Sesshaupt, both of Fed. Rep. of Germany

[73] Assignee: Mistral Windsurfing A.G., Basserdorf, Switzerland

[21] Appl. No.: 448,174

[22] Filed: Dec. 9, 1982

Related U.S. Application Data

[63] Continuation of Ser. No. 205,160, Nov. 10, 1980, abandoned.

[30] Foreign Application Priority Data

Nov. 9, 1979 [DE] Fed. Rep. of Germany ..... 2945235
Oct. 31, 1980 [DE] Fed. Rep. of Germany ..... 3041146

[51] Int. Cl.[3] ..... B63H 9/04

[52] U.S. Cl. ..... 114/39; 280/622; 441/70; 441/74

[58] Field of Search ..... 114/39; 280/619, 621, 280/622; 24/211 N, 115 L, 136 A, 170, 171, 191, 194, 263 R, 163 R; 40/108, 398; 441/70, 74, 75

[56] References Cited

U.S. PATENT DOCUMENTS 2,107,878 2/1938 Strauss ..... 24/163 R
2,583,786 1/1952 Marzucco ..... 403/108
2,816,339 12/1957 Prete, Jr. et al. ..... 24/170
3,980,409 9/1976 Turner ..... 403/108
4,131,963 1/1979 Johnson ..... 441/70
4,244,083 1/1981 Aremka et al. ..... 403/398 X

FOREIGN PATENT DOCUMENTS 2916643 6/1980 Fed. Rep. of Germany ..... 114/39
2287251 5/1976 France .

OTHER PUBLICATIONS

Wind Surfing Magazine, "Surf", Aug. 1979, pp. 32–34.

*Primary Examiner*—Sherman D. Basinger
*Attorney, Agent, or Firm*—Armstrong, Nikaido, Marmelstein & Kubovcik

[57] ABSTRACT

A footloop for a windsurfing board having a deck with a top surface. The footloop is formed of a strap having opposite ends attached at the ends to the top surface of the board, including a device for attaching at least one of the ends to the deck which includes a releaseable mechanism for holding an end portion of the strap until a certain amount of force is exerted on the strap, whereupon the strap is released. The releaseable mechanism is adjustable for differing amounts of force and includes a fixed member permanently affixed to the board, a moveable member co-acting with the fixed member for holding the end portion of the strap and an adjustable device for locking the moveable member relative to the fixed member until the certain amount of force is exerted on the strap.

19 Claims, 14 Drawing Figures

Fig. 2
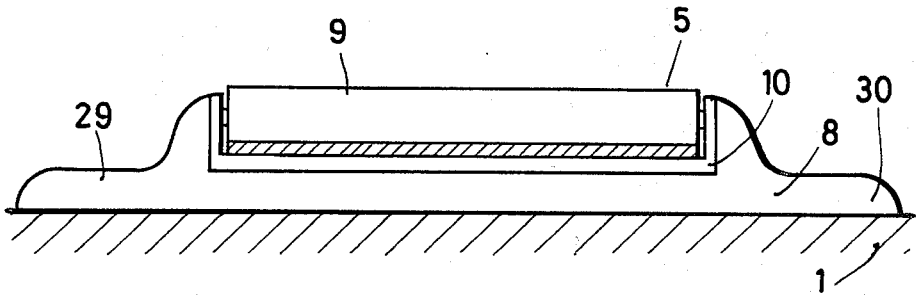
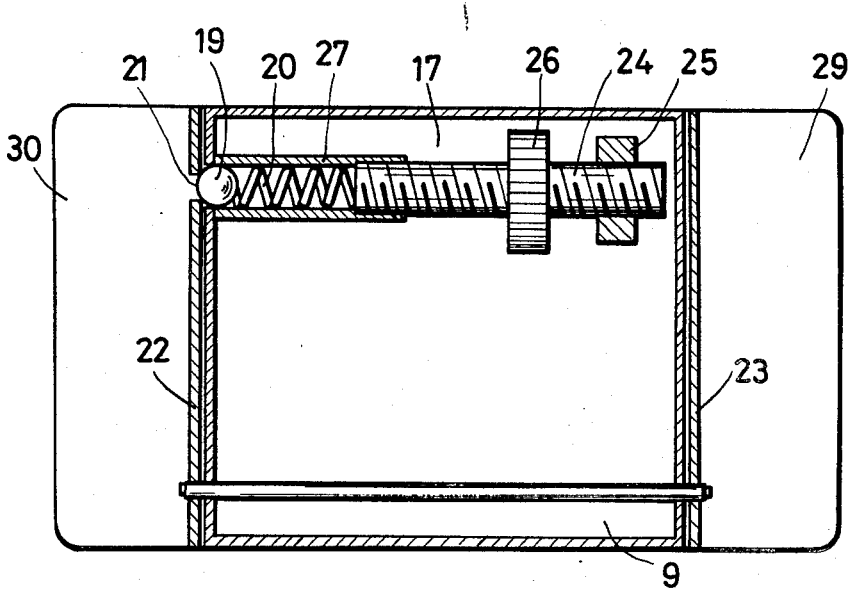
Fig. 3

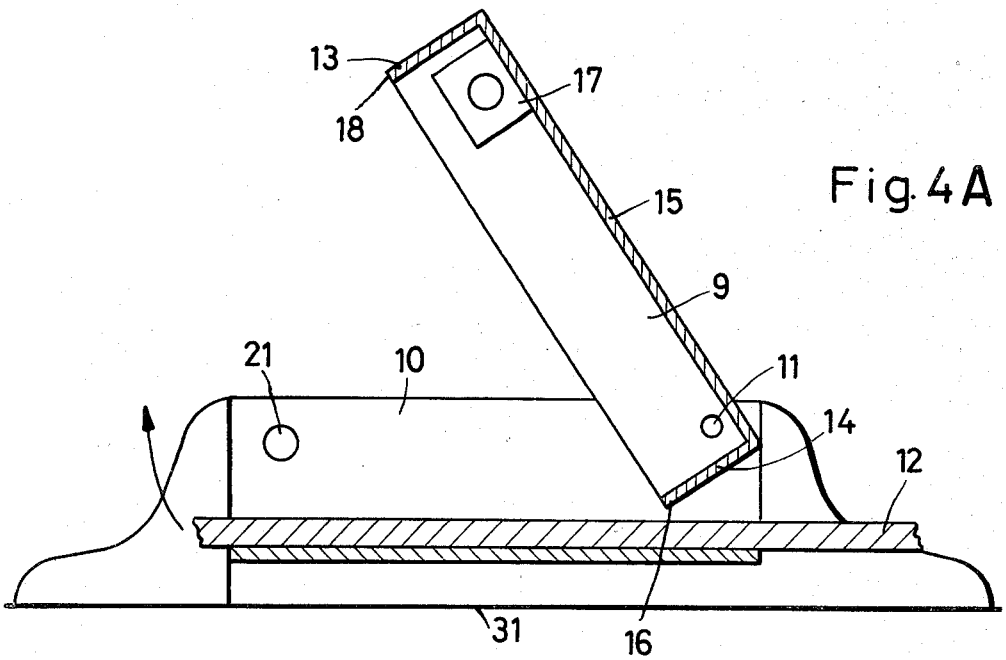
Fig. 4A
Fig. 5
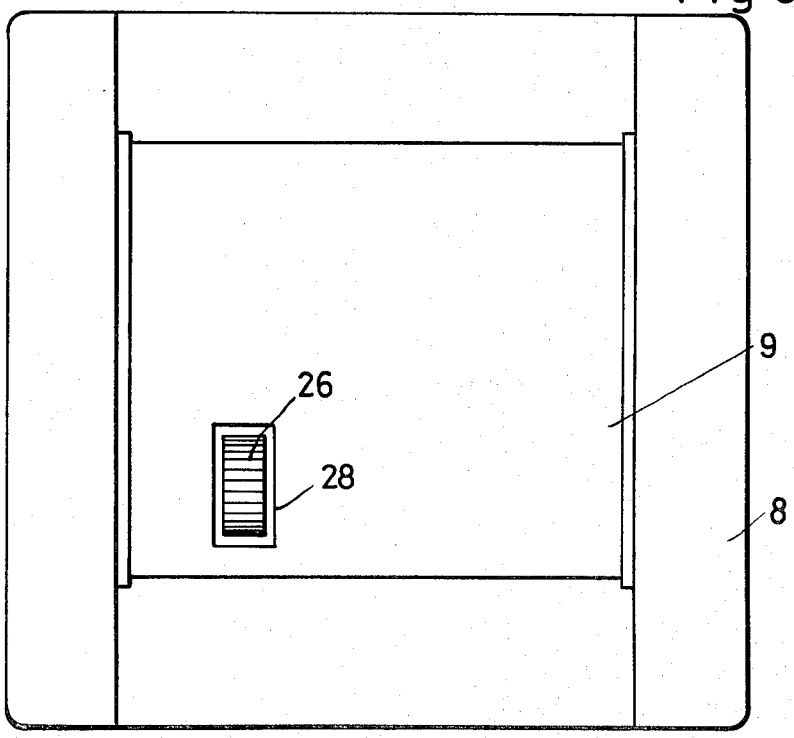

FOOTLOOPS ON SURFBOARDS

This is a continuation of application Ser. No. 205,160 filed Nov. 10, 1980 now abandoned.

The invention is with respect to foot loops on wind surfing boards placed on such boards in groups or singly on the top deck topface thereof, the loops being made up of a length of strap, joined at the two ends with the deck of the wind surfing board.

Such foot loops are widely known (see Windsurfing Magazine Surf, Aug. 1979, pages 32–34), and are generally made up of a broad strap, for example of the same cross-section as an automobile safety belt. For making the strap stiffer and for giving a cushioning effect the strap may be given a casing of coated neoprene, stitched together in the form of a pipe. In the prior art such foot loops had to be of such a size that the user's feet may be slipped in and out of them freely, because, on changing course, the wind surfer has to put his feet in different positions on the deck surface of the wind surfing board. The classical system is to have the loops, for example three loops, generally at the same spacing from the line running between the front edge of the fin and the ends of centerboard trunk, while to the two sides of the trunk further pairs of such foot loops are positioned, the pairs having an opening angle of about 45° and opening in an outward direction like a letter V. In the case of prior art foot loops the strap is fixed to the roughened face of the surf board by adhesive with or without screws and plugs in addition. In the case of surf boards made of glass fiber reinforced synthetic resin, the two ends of the strap are laminated onto the glass matting and synthetic resin of the surfing board at a position where it is roughened for making the adhesive join.

A shortcoming with prior art foot loops is that after fixing the strap, forming the foot loops, to the surf board the size of the opening of the loop is fixed once and for all so that no change in its size will be possible later, for example to take into account the user having shoes on or not. However, more specially, the most serious shortcoming of prior art foot loops is that on falling from the surfing board, it may not be possible for the user to get his feet clear quickly enough and there is chance of danger to life and limb.

One purpose of the invention is that of designing foot loops of the sort noted which are free of these shortcomings and making certain that the person usng the surfing board is able to get his feet clear on falling into the water, on the same lines as is the case with ski safety bindings.

These and other purposes are effected in the case of a foot loop of the sort noted generally in that at least one end of the strap is joined with the surfing board by a unit which may be triggered for opening up and freeing the stap forming the foot loop, and may be self-locked in the done-up condition and in that the force needed for triggering the unit is adjustable.

More specially, one useful effect on the foot loop is that it may take the form of a true "safety binding" for wind surfing boards and which may be adjusted to be in line with the user's own needs and skill with respect to their safety, that is to say the point at which the loop is opened for freeing the user's foot.

In a preferred form of the invention, the unit is kept in the done-up or shut condition by the locking effect of at least one member, which is able to take effect between two parts which may be moved in relation to each other, the locking member being acted upon by a spring element for moving it into a locking position, and the spring force is adjustable.

With respect to details, a useful effect is produced if the parts are made up of a base or frame, joined with the surfing board, and a keeper turningly joined to the base and which may be turned upwards for opening, the strap being run through between the keeper and the base.

With respect to a further detail of the invention, in a further development thereof, the keeper takes the form of a lever which is turningly fixed in position at its one end, this end being more specially in the part of the base which is furthest from the foot loop.

In the case of one form of the invention the strap forming the foot loop is fixed to the free end of the keeper.

In the case of a further, somewhat changed form of the invention producing the useful effect that the foot loop size may be adjusted, the strap forming the foot loop is threaded through under a gripping face formed on the keeper.

The gripping face is preferably at the end of the keeper which is nearest to the axis of turning of the keeper.

With respect to further details of design, in a further development of the invention, the keeper may be designed so that, as seen in cross-section parallel to the length of the strap, it has the form of a letter U, the legs of the letter U being short in comparison with the U cross-piece. In the case of this form of the invention the gripping face is formed on the lower edge of the leg (which is near to the axis of turning) of the U-cross-section.

A more specially preferred working example of the invention is so designed that the lock, formed by the said member and the spring part, is positioned at that end of the keeper, which is nearer to the foot loop. In this respect it is best for the keeper to have a triggering side or face which is on a lever arm able to turn about the said axis of turning. The useful effect with this form of the invention is that the increased pulling force of, or on, the foot loop takes effect on the safety lock itself and, on becoming greater than the holding force to which the system is adjusted, makes certain, because of the levering effect, of safe triggering and release.

The triggering face may, in the case of one form of the invention, be designed as the lower face of that leg of the U cross-section which is near the foot loop.

Furthermore, for the comfort of the user, it is preferred for the system to be so designed that the triggering force may be adjusted from the top side of the keeper. For this reason such adjustment may be undertaken when the safety lock is in its locked position.

In the case of one form of the invention the keeper is made of metal, more specially of stainless steel.

In a further preferred form of the invention the base body is so designed that the keeper is completely within it when the keeper is shut, this making certain that there is no chance of the surf board user wounding himself on any edges or corners sticking out from the rest of the unit.

The base body may more specially be made of a synthetic resin which is compatible with the synthetic resin of the wind surfing board.

However in a preferred form of the invention the base body has an inner reinforcement of metal, more specially stainless steel, which at the same time has bearing eyes for the turnpin of the keeper and/or parts for making possible positive locking of the safety lock. In the case of one form of the invention the reinforcement may be a piece of upwardly open U-girder, it forming at the same time a guide for the strap and being a little greater in size than the U cross-section of the keeper. The U-girder is in this respect joined, if necessary, by a further fixing system to the synthetic resin on the base body.

For fixing the base body, it may have a lower adhesive face for joining up with the surf board and having furthermore, if desired, at least two side wings for laminating onto the surf board or for taking up screws for fixing thereto. The useful effect in this respect is that surf boards may later have such foot loops fixed to by the user, to give the function of a safety binding.

Further possible forms of the invention and teachings thereof for making use of the general idea of the invention will be seen from the account now to be given.

These forms of the invention will now be made clear using the working examples to be seen in the figures.

FIG. 2 is a rough, general view of the front part of the fixing unit for the strap.

FIG. 3 is a cutway view of the fixing unit of FIG. 2, in the form of a sketch.

FIG. 4A is a view of the unit of FIGS. 2 and 3 in the undone condition.

FIG. 5 is a plan view of the unit of FIG. 2 without the strap.

Figure 11:
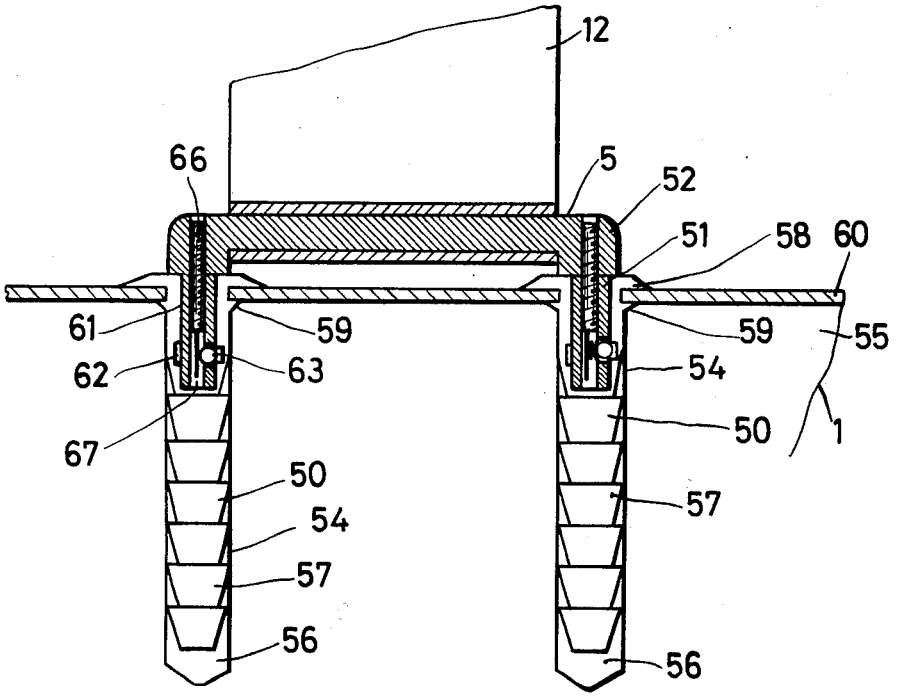
FIG. 11 is a diagrammatic cutaway view or section of a further working example of the foot loop of the present invention.
Figure 11A:
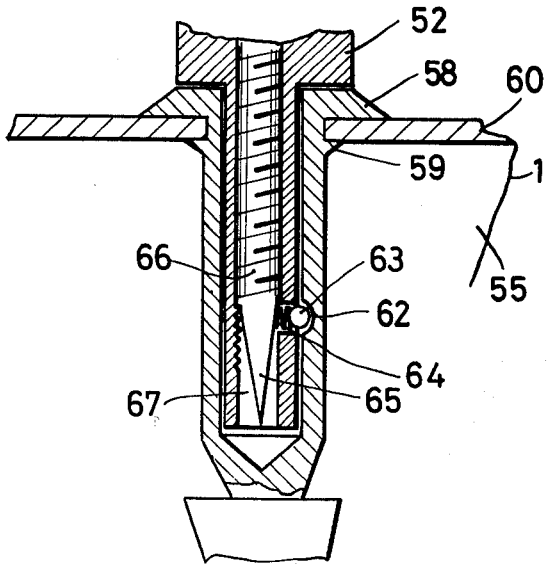

FIG. 11*a* is a section of part of the structure to be seen in FIG. 11.

Figure 12:
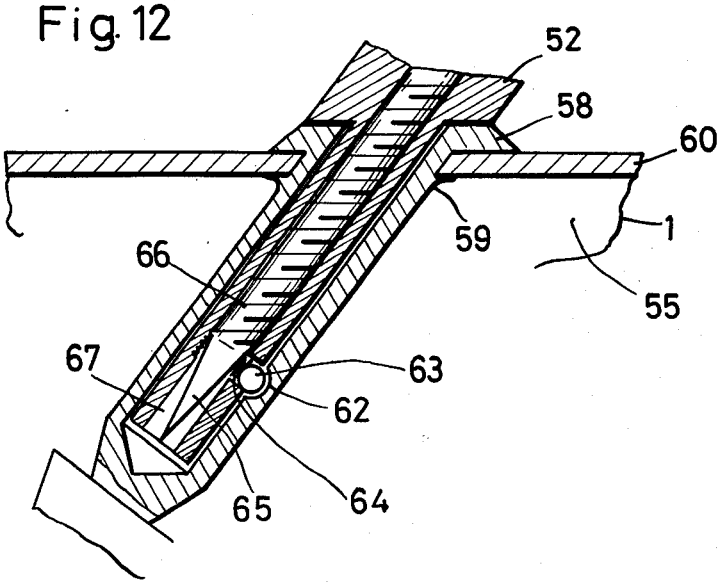

FIG. 12 is a diagrammatic cutaway view or section of the joining up part in the structure of FIG. 11.

Figure 1:
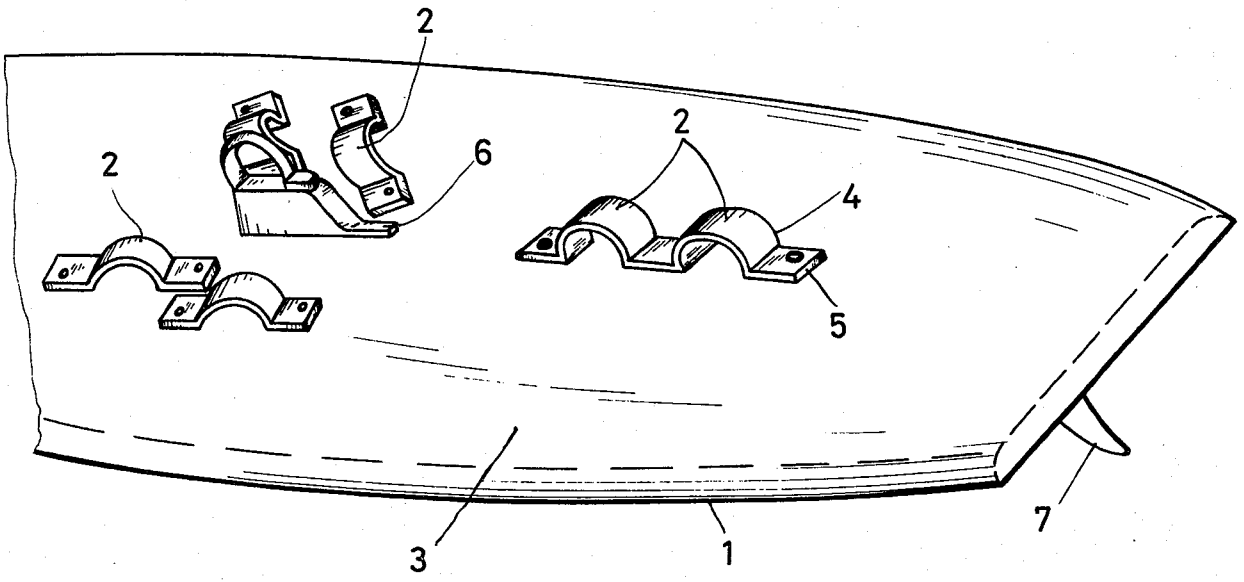
FIG. 1 is a perspective view of the stern part of a wind surfing board having the U foot loops of the present invention.

FIG. 1 is a general view of the stern part of a wind surfing board 1, on whose deck topface 3 foot loops 2 of the present invention are placed. The foot loops 2 are made up of lengths 4 of strap, generally having the same cross-section as automobile safety belts. The lengths 4 of strap are joined at at least one of their ends with a unit, designed on the lines of a safety binding, with the stern topface 3 of surfing board 1. A detailed account of this fixing unit will be given later on the footing of the rest of the figures of the drawings. In FIG. 1 this fixing unit is generally numbered 5. In the case of the system to be seen in FIG. 1 two pairs of foot loops 2 are placed at the two sides of the centerboard trunk 6 of the surfing board 1, and they are placed at an angle of about 45° to the middle line of the surfing board. A further pair of foot loops 2 is placed on the line running between the fin 7 and the centerboard trunk 6. In place of these two foot loops 2 it will be possible to have three or four such foot loops, in the case of which, as well, at least one of the ends of each loop is joined up with the surfing board by way of a fixing unit 5.

An account will now be given of the working example of the fixing unit 5 which is to be seen in FIGS. 2 to 6, and having the effect of a safety binding. In the case of the working example to be seen in the figures it is a question of a specially rugged and very simple design which is resistant to saltwater and furthermore sand, its function being quite as good even when used in saltwater and contacted by sand.

As can be seen in FIGS. 2 and 4A, the unit 5 is made up of a base body 8 and a keeper 9. The base body 8 is fixedly joined to the surfing board 1 and is best made of a synthetic resin which may be safely joined to the synthetic resin of the surfing board by adhesive or by a process of lamination, it being further fixed in place if necessary by screws, not shown. Base body 8 furthermore has a reinforcing part 10, which is preferably made of stainless steel and has the form of a letter U in cross-section, with its legs running upwards.

Figure 6:
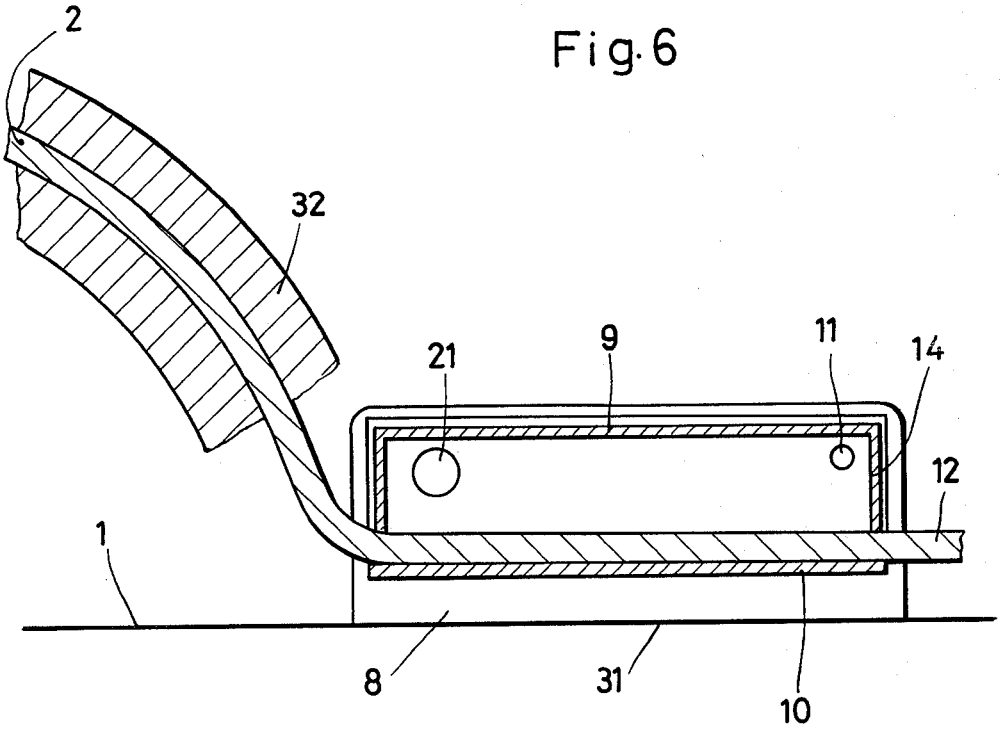
FIG. 6 is a rough side cutway view of the unit of FIGS. 2 to 5 in the shut condition.
Figure 7:
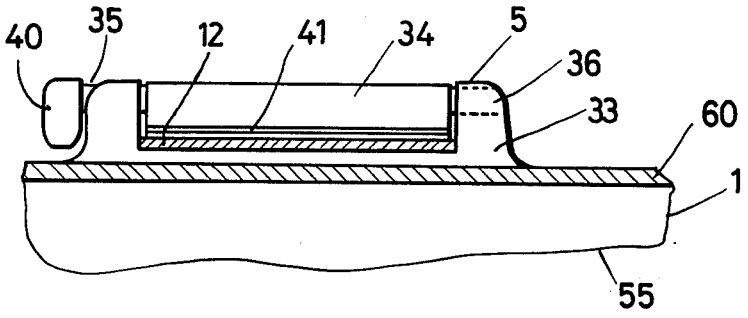
FIG.7 is a view, on the same lines as FIG. 2, of a further working example of the invention.
Figure 8:
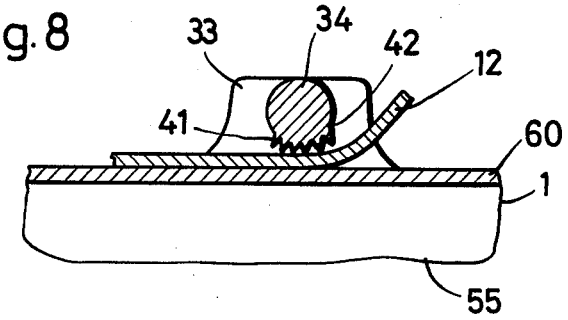
FIG. 8 is a side view of the unit of FIG. 7.

As may be seen in more detail in FIGS. 3, 4A and 6, in the present working example of the invention, the keeper 9 is in the form of a box-like part turningly supported like a lever by a turnpin 11 at one of its ends. In the cutaway view or section, taken parallel to the main direction of the strap 12, of FIG. 4A, the keeper 9 as well has a downwardly open U-like cross-section, that is to say it is like a piece of U-girder, the two legs 13 and 14 of the U cross-section being shorter than its cross-piece 15. As will be seen from the view of FIG. 6, the leg 14, next to turnpin 11, has its lower edge designed as a gripping face 16, which in the done-up condition of the fixing unit 5 has the function of gripping and squeezing 12 safely against reinforcing part 10. The lower edge of the front leg 13, which is next to the safety lock 17 boxed in keeper 9, as will be made clear in further detail later on using FIG. 3, takes the form of a triggering face or trigger 18, which when acted upon has the function of releasing keeper 9, undoing safety lock 17, because of the effect of the strap 12, with an upwardly directed motion about turnpin 11, this freeing strap 12, when the force, taking effect on foot loop 2, becomes greater than the adjusted value.

FIG. 3 is a cutaway view or section of a specially simple and rugged working example of the safety lock 17 boxed in keeper 9. As will be seen, the safety lock itself is in this case made up of a member, in the present case a ball 19, forced by the effect of a spring 20 lockingly into a locking hollow, detente, or opening 21 in at least one of the side walls 22 and 23 of the reinforcing part 10 of U-like cross-section. The force or preloading effect of spring 20 may undergo adjustment using an adjustment screw 24, which at its one end is screwed into a threaded hole in a backup 25 and into a threaded pipe 27 (having spring 20 within it) into which it may be screwed and from which it may be unscrewed as may be desired, one end of spring 20 resting against ball 19 and the other end resting against adjustment screw 24.

It will be clear that, using this design, adjustment of the force needed for pushing ball 19 back out of opening 21, may undergo very simple adjustment. When the ball 19 is pushed clear of opening 21, keeper 9 may be moved into the position of FIG. 4A to let strap 12 be slipped through the fixing unit so that the foot loop 2 becomes greater and the surf board user may get his foot free if it has been trapped in it.

Figure 4B:
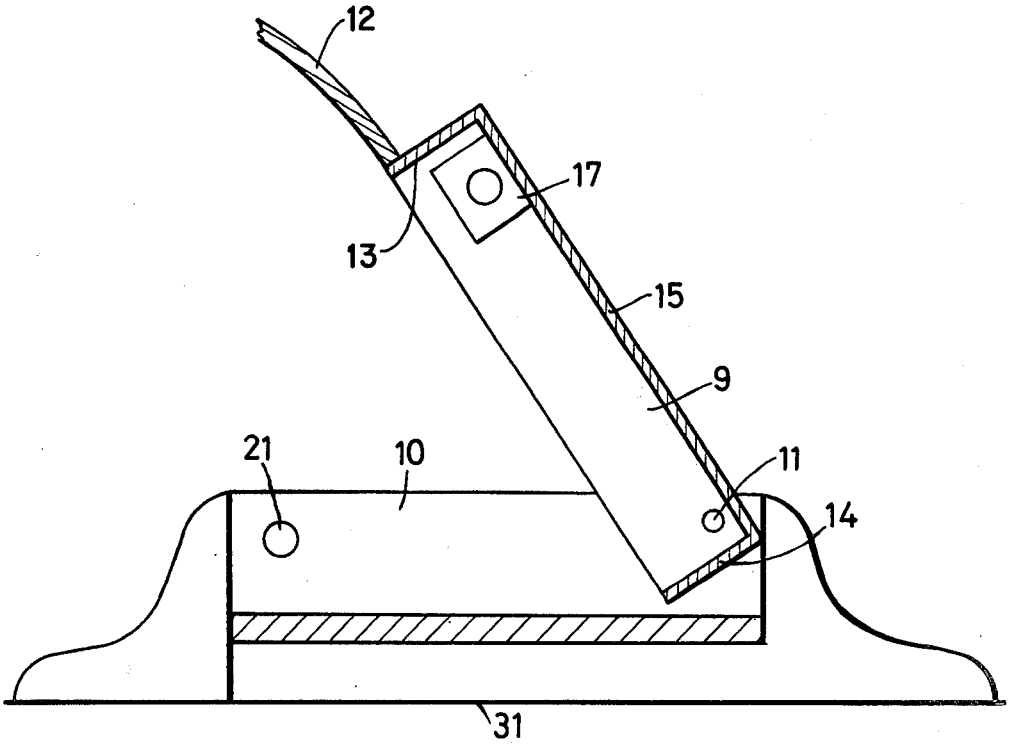
FIG. 4B is a cross-sectional view of another working example of the invention.

In the case of a further possible design of the invention shown in FIG. 4B in place of letting strap 12 completely be slipped through the fixing unit, it may be joined with the front leg 13 of keeper 9 so that the upwardly acting turning motion of the keeper 9 will make the diameter or size of foot loop 2 greater to the necessary degree for the user to take his foot out of it, when the keeper 9 is turned upwards. In the case of such a design adjustment of the size of the foot loop 2 is no longer possible at this end of the strap, but however in place of the fixed connection of the leg 13 of the keeper 9 here, it would be possible to have an adjustable system.

It will furthermore be seen from FIG. 5 that thumb wheel 26 on adjustment screw 24 is designed sticking upwards through a slot or opening 28 out through keeper 9 so that adjustment of the triggering or release force may be undertaken by changing the force produced by spring 20, even when keeper 9 is shut.

As will furthermore be seen from the figures, for making the system safer and decreasing the danger of the user wounding himself, on the one hand base body 8 is designed with a rounded off outer face and on the other hand keeper 9 is of such a size that it is completely taken up within the U-cross section of reinforcing part 10 so that no sharp edges and other parts will be sticking out past the general outline of the fixing unit.

As will furthermore be seen from the figures, on base body 8 at least two side fixing wings 29 and 30 are present which may be fixed to the deck by a process of laminating with or without screws in addition. Furthermore base body 8 has a lower adhesive face 31 which is designed for fixing to the deck of the surf board over a wide area by adhesive.

It is clear that, without being limited to the working example noted, the present invention is based on, and makes possible, the general idea of a safety binding for foot loops on wind surfing boards. Those in the art will be able to make a great number of changes and further developments without giving up the base-idea of the invention. For example such a man in the art will be conscious of a number of different ways of designing the safety lock 17 making use of the most different members or using a greater or lesser frictional effect, which may be adjustable as well. The only important point is that, using an adjustable triggering or release force, such a foot loop may be designed for freeing the foot of a surf board user, when his foot is trapped in the loop.

In FIG. 6 a further detail of the invention will be seen; in this case, as part of the invention, at least one end of the strap 12 is not permanently joined to surfing board 1. As will be seen in FIG. 6, there is a pipe 32, taking the form of a conventional cushion of coated neoprene, round the strap. Pipe 32 is cut up into lengths which are separately placed on strap 12 so that stitching, which would be undesired, is not used at all.

In the working example of the invention to be seen diagrammatically in FIGS. 7 to 10, the fixing unit, generally numbered 5, takes the form of a housing 33 of U-like cross-section and which is joined to wind surfing board 1. Housing 33 is, once again, best made of a synthetic resin which may be safely and permanently joined to the synthetic resin of the surfing board by adhesive or by a process of lamination, screws being used as well in addition if desired. As was the case in the working examples of FIGS. 1 to 6, it is possible here as well to make use of the reinforcing part of stainless steel or the like.

Keeper 9 is in the case of this form of the invention made up of a turnpin 34, bearinged in bearing eyes 35, 36 in the upright legs of the U cross-section. Strap 12 is slipped under turnpin 34, the turnpin being normal to the main direction of strap 12.

Turnpin 34 as well has a gripping face 16 which is eccentric with respect to the axis of turning of turnpin 34. Gripping face 16 has teeth 41 parallel to turnpin 34, teeth 41 being on the eccentric part 42 of turnpin 34.

Figure 9:
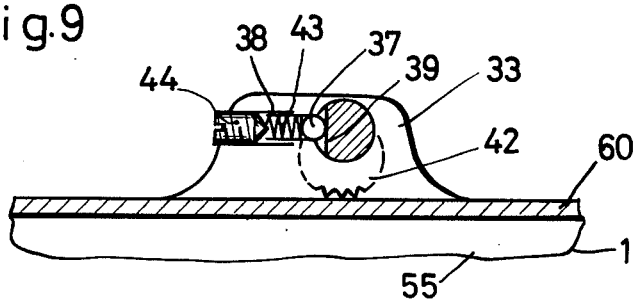
FIG. 9 is a partly cutaway side view of the foot loop of FIG. 7, as seen from one side.

As will be seen from the diagrammatic cutaway view or section of FIG. 9, turnpin 34 is stopped from turning by a safety lock 17 which is so designed that it is only locked when strap 12 is gripped between the lower wall of housing 33 and the eccentric part 42.

In the case of the present working example of the invention, the safety lock 17, made up of a ball 37 placed in a hole 38 in housing 33 and forced by spring 43 against flat 39 on turnpin 34, may be adjusted by screw 44 which may be screwed further into or out of threaded hole 38.

As the reader will have seen, there is only a short lever arm between the axis of turning of turnpin 34 and the outer face of eccentric part 42 of teeth 41 and for this reason the spring 43 may be generally weak so that the triggering or release force, necessary for freeing strap 12 on turning turnpin 34, may be very finely adjusted.

Figure 10:
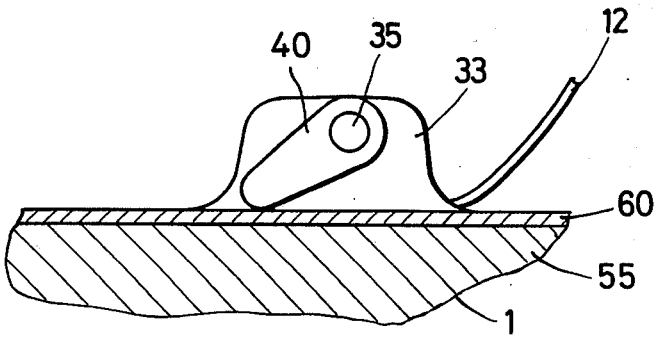
FIG. 10 is a side view of the foot loop of FIG. 7, as seen from the opposite side.

As will be seen from the sideview of FIG. 10, in the preferred working example of the invention, on the side, opposite to safety lock 17, of turnpin 34 there is a lever 40 which the user may take in his hand from the outside for turning turnpin 34 for freeing strap 12. Lever 40 is used in this respect on the one hand for changing the size of the foot loop and on the other hand for threading it in again, if is completely run out of the fixing unit after being acted upon by a force greater than the force adjusted by safety lock 17. The system is best so designed that in the locked-in condition, lever 40 is in a position as seen in FIG. 10, that is to say as near as possible to the topface of surfing board 1 and housing 33.

In comparison with the working example to be seen in FIGS. 1 to 6, the form of foot loop of FIGS. 7 to 10 has the useful effect that it is very much lighter and takes up less space and furthermore, because of its smaller overall size and rounded off, neat outline there is no danger of injury.

An account will now be given of a more specially preferred working example of the invention, using FIGS. 11, 11*a* and 12.

As will be seen from FIGS. 11 and 11*a*, in the case of this form of the invention one of the parts of the fixing unit is in the form of screw fixing plugs or hollow cylinders 50 (fixed in the deck of the wind surfing board 1) while the other of the parts 8, 9 is in the form of an U-like pin member 52 or the like having a center section, to which strap 12 of the foot loop is fixed. Between the plug bodies 50 and U-like part 52 connection pieces, generally numbered 51, take effect, whose releasing effect (or releasing force) may undergo adjustment as was the case with the forms of the invention detailed earlier.

In the case of the preferred example of the invention, the connection pieces 51 are cylindrical arms of the horseshoe-like or U-part 52 so that the plug bodies may be kept simple in design and furthermore it will be very simple for the surf board user to put the horseshoe-like parts 52 in different pairs of plug bodies 50 in his surfing board 1.

The plug bodies 50 are best made of round aluminum moldings, placed in holes 54 in surfing board 1 and running into its foam core 55. For fixing the plugs in place, the holes are partly filled with synthetic resin 56, the resin making a strong connection with teeth or wings 57 on the plug bodies and stopping them from being pulled out of the surfing board 1.

Preferably the plug bodies 50 furthermore have teeth or wings 59 opposite to the head part 58 of the plug bodies 50, the tooth or wing 59 being so designed that the outer skin 60 of a surfing board is lockingly positioned between the head part 58 and the further tooth or wing 59.

The plug bodies 50 have in their head parts 58 a hole 61, which, as more specially will be seen from FIG. 12, has a ring-groove 62 in its bore face, the groove being for taking up a ball 63 of the safety lock 17 of the connection pieces 51 to give a locking function.

As is the case with the forms of the invention detailed so far, the force produced by spring 64 and acting on the ball, may be adjusted from outside, for which purpose a screw 66, having a pointed end 65 is used and which may be screwed for moving it in and along a threaded hole 67 in the U-like or horseshoe-like part 52.

In the case of a further form of the invention, to be seen in a general, rough view in FIG. 12, the head part 58 is at an angle to the rest of the plug body 50, the plug being fixed in the surfing board in it hole 61 which is generally in the direction of pull of strap 12. In the case of this form of the invention triggering or release of the safety lock while keeping clearly in line with the direction of the pulling force is possible in an even more certain way than with the other forms of the invention.

In the account given the nature of the invention has been made clear on the footing of a small number of working examples, the gist of the invention being that foot loops, with a sort of safety binding, are to be fixed on wind surfing boards so that they may be released and undone. Those trained in the art will be conscious of a number of different designs in this respect, more specially in connection with the form of the safety lock, such further developments being covered by and part of the teaching of the present invention.

All measures given in the specification, the claims and the figures, and furthermore usefull effects of the invention in this respect, together with details of design and of configuration, may be important for the invention when taken separately or when grouped together.

We claim:

1. A footloop for a windsurfing board having a deck with a top surface comprising:

a strap having opposite ends and being attached at said ends to the top surface thereby forming a loop; and attaching means for attaching at least one of said ends to the deck which includes releasable means for holding an end portion of said strap until a certain predetermined amount of force is exerted upwardly on a portion of the strap forming the loop whereupon said strap is automatically released, said releaseable means being adjustable for differing amounts of force, said releasable means comprising:

a fixed member including a pair of upstanding members permanently affixed to the board, a turnpin pivotally mounted between said upstanding members having an eccentric axis of rotation and a gripping face, said end portion of said strap being threadingly received and held between said gripping face and said fixed member, and adjustable means for locking said turnpin relative to said fixed member until said certain predetermined amount of force is exerted on said strap, said adjustable means for locking being mounted in one of said upstanding members and engaging said turnpin.

2. The footloop as claimed in claim 1 wherein said gripping face is toothed.

3. The footloop as claimed in claim 2 wherein said adjustable means for locking comprises a locking member in engagement with said turnpin and a spring providing a spring force urging said locking member against said turnpin.

4. The footloop as claimed in claim 3 wherein said locking member is a ball housed in a bore in said one upstanding member and said adjustable means further comprises a flat surface parallel to said axis of rotation on said turnpin adjacent to said bore and means for adjusting said spring force.

5. The footloop as claimed in claim 4 further comprising a lever provided on one end of said turnpin.

6. A foot loop for a windsurfing board having a deck with a top surface comprising:

a strap having opposite ends and being attached at said ends to the top surface thereby forming a loop; and attaching means for attaching at least one of said ends to the deck which includes releasable means for holding an end portion of said strap until a certain predetermined amount of force is exerted upwardly on a portion of the strap forming the loop whereupon said strap is automatically released, said releasable means being adjustable for differing amounts of force, said releasable means comprising:

a fixed member comprising a pair of hollow cylinders permanently embedded in the board, a moveable member coacting with said fixed member for holding said portion of said strap, said moveable member comprising a U-shaped member having a central section and a pair of cylindrical arms insertable into said pair of hollow cylinders, said end portion of said strap being fixed to said center section, and adjustable means for locking said moveable member relative to said fixed member until said certain predetermined amount of force is exerted on said strap.

7. The footloop as claimed in claim 6 wherein said adjustable means for locking comprises a detente on an interior surface of each of said hollow cylinders, a ball housed in each of said arms engageable with said detentes, a spring providing a spring force urging each of said balls to engage said detentes, and means for adjusting said spring force.

8. A foot loop for a windsurfing board having a deck with a top surface comprising:

a strap having opposite ends and being attached at said ends to the top surface thereby forming a loop; and attaching means for attaching at least one of said ends to the deck which includes releasable means for holding an end portion of said strap until a certain predetermined amount of force is exerted upwardly on a portion of the strap forming the loop whereupon said strap is automatically released, said releasble means being adjustable for differing amounts of force, said releaseable means comprising:

a fixed member permanently affixed to the board, a moveable member coacting with said fixed member for holding said portion of said strap, and adjustable means for locking said movable member relative to said fixed member at a locked position until said certain predetermined amount of force is exerted on said strap; said adjustable means for locking comprising a locking member, a detente, and a spring producing a spring force urging said locking member to engage said detente, said locking member and said spring being housed in said moveable member and said detente is positioned on said fixed member so as to be engaged by said locking member when said moveable member is in said locked position.

9. The footloop as claimed in claim 8 wherein said moveable member is a keeper pivotally mounted on said fixed member and having a pivoted end and a free end, said free end being positioned nearest the portion of said strap forming the loop.

10. The footloop as claimed in claim 9 wherein said locking member and said spring are housed in said keeper adjacent said free end and said detente is positioned on said fixed member so as to be engaged by said locking member when said free end is adjacent said fixed member.

11. The footloop as claimed in claim 10 wherein said adjustable means for locking further comprises means for adjusting said spring force.

12. The footloop as claimed in claim 9 wherein said keeper is U-shaped in longitudinal cross-section having a cross-piece along a longitudinal axis and two depending legs, said legs being shorter in length than said cross-piece.

13. The footloop as claimed in claim 12 wherein said fixed member is U-shaped in lateral cross-section having two upstanding leg portions, said detente being on one of said leg portions.

14. The footloop as claimed in claim 12 wherein said end portion of said strap is threadingly received between said keeper and said fixed member and the leg closest to said pivoted end has a lateral gripping face pressing said end portion against said fixed member when said free end is adjacent said fixed member.

15. The footloop as claimed in claim 14 wherein said keeper is made of stainless steel.

16. The footloop as claimed in any one of claims 9, 10, 11, or 13 wherein said end portion of said strap is threadingly received and held between said keeper and said fixed member.

17. The footloop as claimed in claim 16 wherein said keeper is made of stainless steel.

18. The footloop as claimed in any one of claims 9, 10, 11, 12 or 13 wherein said end portion of said strap is attached to said free end on said keeper.

19. The footloop as claimed in claim 18 wherein said keeper is made of stainless steel.

* * * * *